US006920991B2

(12) United States Patent
Holley, Jr.

(10) Patent No.: US 6,920,991 B2
(45) Date of Patent: Jul. 26, 2005

(54) MULTI-CHAMBERED CONTAINER AND TWO-PIECE ADAPTER

(75) Inventor: James W. Holley, Jr., Colorado Springs, CO (US)

(73) Assignee: Insta-Mix, Inc., Colorado Springs, CO (US)

( * ) Notice: Subject to any disclaimer, the term of this patent is extended or adjusted under 35 U.S.C. 154(b) by 111 days.

(21) Appl. No.: 10/402,712

(22) Filed: Mar. 28, 2003

(65) Prior Publication Data

US 2004/0188371 A1 Sep. 30, 2004

(51) Int. Cl.[7] ..... B65D 1/04; A61J 9/00; A61J 11/00

(52) U.S. Cl. ..... 215/6; 215/11.1; 215/11.3; 215/11.4; 215/DIG. 8; 206/219; 220/502

(58) Field of Search ..... 215/6, 11.1, 11.4, 215/11.5, DIG. 8; 426/117; 220/254.3, 501, 502; 206/219

(56) References Cited

U.S. PATENT DOCUMENTS

| | | | | | |
|---|---|---|---|---|---|
| 1,333,051 | A | * | 3/1920 | Young | 220/252 |
| 1,691,811 | A | * | 11/1928 | Johnson | 222/507 |
| 1,747,550 | A | * | 2/1930 | Klimburg | 222/507 |
| 2,197,672 | A | * | 4/1940 | Winters | 222/490 |
| 2,793,776 | A | | 5/1957 | Lipari | |
| 2,807,384 | A | | 9/1957 | Lipari | |
| 2,813,649 | A | | 11/1957 | Lipari | |
| 3,704,803 | A | | 12/1972 | Ponder | |
| 3,791,548 | A | * | 2/1974 | Gili | 220/502 |
| 4,545,491 | A | | 10/1985 | Bisgaard et al. | |
| 4,865,207 | A | | 9/1989 | Joyner et al. | |
| 4,869,381 | A | | 9/1989 | Agner | |
| 4,981,022 | A | | 1/1991 | Snyder | |
| 5,244,122 | A | | 9/1993 | Botts | |
| 5,275,298 | A | | 1/1994 | Holley, Jr. et al. | |
| 5,402,907 | A | * | 4/1995 | Liu | 220/502 |
| 5,419,445 | A | * | 5/1995 | Kaesemeyer | 215/11.1 |
| 5,467,877 | A | | 11/1995 | Smith | |
| 5,540,341 | A | | 7/1996 | Holley et al. | |
| 5,555,741 | A | | 9/1996 | Oakley | |
| 5,678,709 | A | | 10/1997 | Holley et al. | |
| 5,685,447 | A | | 11/1997 | Springett et al. | |
| 5,692,627 | A | | 12/1997 | Feng | |
| 5,863,126 | A | * | 1/1999 | Guild | 366/130 |
| 6,123,065 | A | | 9/2000 | Teglbjarg | |
| 6,134,894 | A | | 10/2000 | Searle et al. | |
| 6,139,802 | A | * | 10/2000 | Niermann et al. | 422/102 |
| 6,161,712 | A | * | 12/2000 | Savitz et al. | 215/312 |
| 6,257,429 | B1 | * | 7/2001 | Kong | 215/11.3 |

FOREIGN PATENT DOCUMENTS

WO WO 93/25446 * 12/1993

* cited by examiner

*Primary Examiner*—Sue A. Weaver
(74) *Attorney, Agent, or Firm*—Bever, Hoffman & Harms, LLP; Patrick T. Beyer

(57) ABSTRACT

A multi-chambered container assembly including a two-piece adapter having a base and a hollow member that cooperate to open and close a passage between a first chamber provided by a bottle and a second chamber formed in the hollow member. The base defines a first opening and has a substantially semi-spherical concave wall surrounding the first opening, and the hollow member includes a substantially semi-spherical convex wall that pivotably (slidably) fits within the concave wall of the base. The hollow member is snap-coupled to the base using a pair of pins and a pair of cam grooves that facilitate movement of the hollow member between a closed (first) position and an open (second) position. The base can be integrally formed onto the bottle to provide a two-piece multi-chambered container.

19 Claims, 3 Drawing Sheets

MULTI-CHAMBERED CONTAINER AND TWO-PIECE ADAPTER

FIELD OF THE INVENTION

The present invention relates to multi-chambered substance containment apparatus for separately storing two or more substances in one container.

RELATED ART

Dehydration is a common method of preserving perishable foods. For example, the usable periods ("shelf-life") of liquid milk is increased from a few weeks to several months or more by dehydrating the liquid milk to form powdered milk. Dehydrated substances are particularly useful when refrigeration is not available because the dehydrated substances can be stored at room temperature. Of course, when dehydrated edible substances are re-hydrated by mixing with a liquid, the shelf-life of the re-hydrated edible substance is typically the same as or shorter than the perishable food from which the dehydrated substance was produced. Therefore, it is advantageous to postpone the hydration process until the dehydrated substance and liquid are mixed; that is, immediately prior to consumption.

Powdered baby formula and water are mixed in conventional single-chamber baby bottles by inserting predetermined amounts of powdered formula and water through the opening formed in the neck of the bottle, attaching a nipple over the opening, and shaking the baby bottle until the powdered formula and water mix to produce liquid baby formula. The liquid baby formula is then either immediately consumed or refrigerated for later consumption.

There are several disadvantages associated with the use of conventional single-chamber containers for preparing hydrated mixtures from a dehydrated substance. One disadvantage is that two storage containers are required to store the water and the dehydrated substance prior to mixing. Mixing requires transferring one of the dehydrated substance and the water from one container to the other. The dehydrated substance and the water can be contaminated during the transfer, particularly when mixing is performed away from home. In addition, in some situations, such as when mixing is performed in a car, spillage or incorrect mixing quantities can result because level surfaces and suitable measuring devices are not available.

Prior art multi-chambered containers addressing the above-described disadvantages are taught in U.S. Pat. Nos. 2,793,776, 2,807,384 and 2,813,649 (the "Lipari patents"), and also in U.S. Pat. No. 5,678,709 ("Holley").

Each apparatus taught in the Lipari patents includes first and second chambers joined by a narrow channel that is blocked by an axially-displaced seal or a seal punctured by an axially-displaced plunger. A problem with these apparatus is that the narrow channel between the first and second chambers is too small to allow thorough mixing of the liquid and substance, and the axially-displaced seals and plunger impede the mixing process. Another problem with the Lipari apparatus is that they include numerous parts and mechanisms that cause the apparatus to be complicated to make and assemble, and expensive to produce.

Holley addresses the problems associated with the Lipari bottles by providing a multi-chambered container including a bottle having a curved wall located over a first opening, a substantially spherical hollow member defining a second opening and having a neck that defines a third opening, and a locking collar that includes a slot. The locking collar is mounted over the hollow member such that the neck of the hollow member extends through the slot, and a lower portion of the locking collar is and attached to the bottle. The hollow member is adjustable between a closed position and an open position by loosening (unscrewing) the locking collar relative to the bottle, rotating the hollow member, and then tightening (screwing) the locking collar. In the closed position a portion of the spherical hollow member wall is disposed to block the first opening, and in the open position the first and second openings align to define a passage between an interior of the bottle and an interior of the hollow member. The rotating or pivoting action of the spherical hollow member wall between the open and closed positions provides a large, unobstructed flow area that avoids the mix-impeding problems associated with the Lipari apparatus. In addition, the rotating or pivoting action allows for a less complicated and less expensive design that the plunger-type mechanism used by Lipari.

Although Holley provides a well-received, commercially-available multi-chambered container, some people find this product somewhat complicated to operate in that rotation of the hollow member between the first and second positions requires loosening and tightening a locking collar, which is needed to securely press the hollow member against an upper portion of the bottle. Moreover, because the locking collar must fit over the neck of the hollow member, the diameter of the hollow member neck is smaller than the diameter of the locking collar, thereby providing only a small opening for inserting substances (e.g., powdered baby formula) into the hollow member. Also, the three-piece assembly (i.e., bottle, hollow member, and locking collar) and complicated shape of the hollow member combine to make the disclosed multi-chambered container relatively expensive to manufacture.

What is needed is a simplified multi-chambered container that easy to operate and inexpensive to manufacture.

SUMMARY

The present invention is directed to a multi-chambered container assembly including a bottle/base and a hollow member that cooperate to open and close a passage between a first chamber provided by the bottle/base and a second chamber provided by the hollow member. The base defines a first opening and includes a substantially semi-spherical (collar-shaped) concave wall surrounding the first opening, and the hollow member includes a substantially semi-spherical convex wall that pivotably fits within the concave wall of the base. The hollow member also includes a selectively sealable third opening for inserting substances therein. The hollow member is snap-coupled to the base using a pair of pins and a pair of cam grooves that facilitate pivoting of the hollow member relative to the base between a closed (first) position and an open (second) position without the need for a locking collar, thereby providing a two-piece mechanism that is both intuitive to use and relatively inexpensive to produce. In addition, because a locking collar is not required, the hollow member can be formed with relatively wide diameter to facilitate relatively easy insertion of substances therein.

According to an embodiment of the present invention, a two-piece adapter for forming a multi-chambered container includes a base including a threaded collar for attaching to the neck of a bottle, and a hollow member that is snap-coupled onto the base. The base includes a first curved wall surrounding a first opening that forms a passage into the bottle, and a pair of pins (cam followers). The hollow member includes a curved second wall, and a pair of cam grooves that receive the pins extending from the base when the hollow member is snap-coupled onto the base. The hollow member also includes a cylindrical wall that extends from the curved wall and defines a third opening that is selectively covered by an optional cap or nipple assembly. The hollow member is pivotable between a first position in which a portion of the curved wall is disposed to block the first opening formed in the base such that a first stored substance is separated from the second stored substance, and a second position in which the first opening aligns with the second opening to form a passage between the interior of the bottle and the interior of the hollow member such that said first substance forms a mixture with said second substance. The cam grooves are arranged to forcibly press the hollow member against the base in each of the first and second positions, and to facilitate rotation of the hollow member between the first and second positions.

The present invention will be more fully understood in view of the following description and drawings.

DETAILED DESCRIPTION

Figure 1:
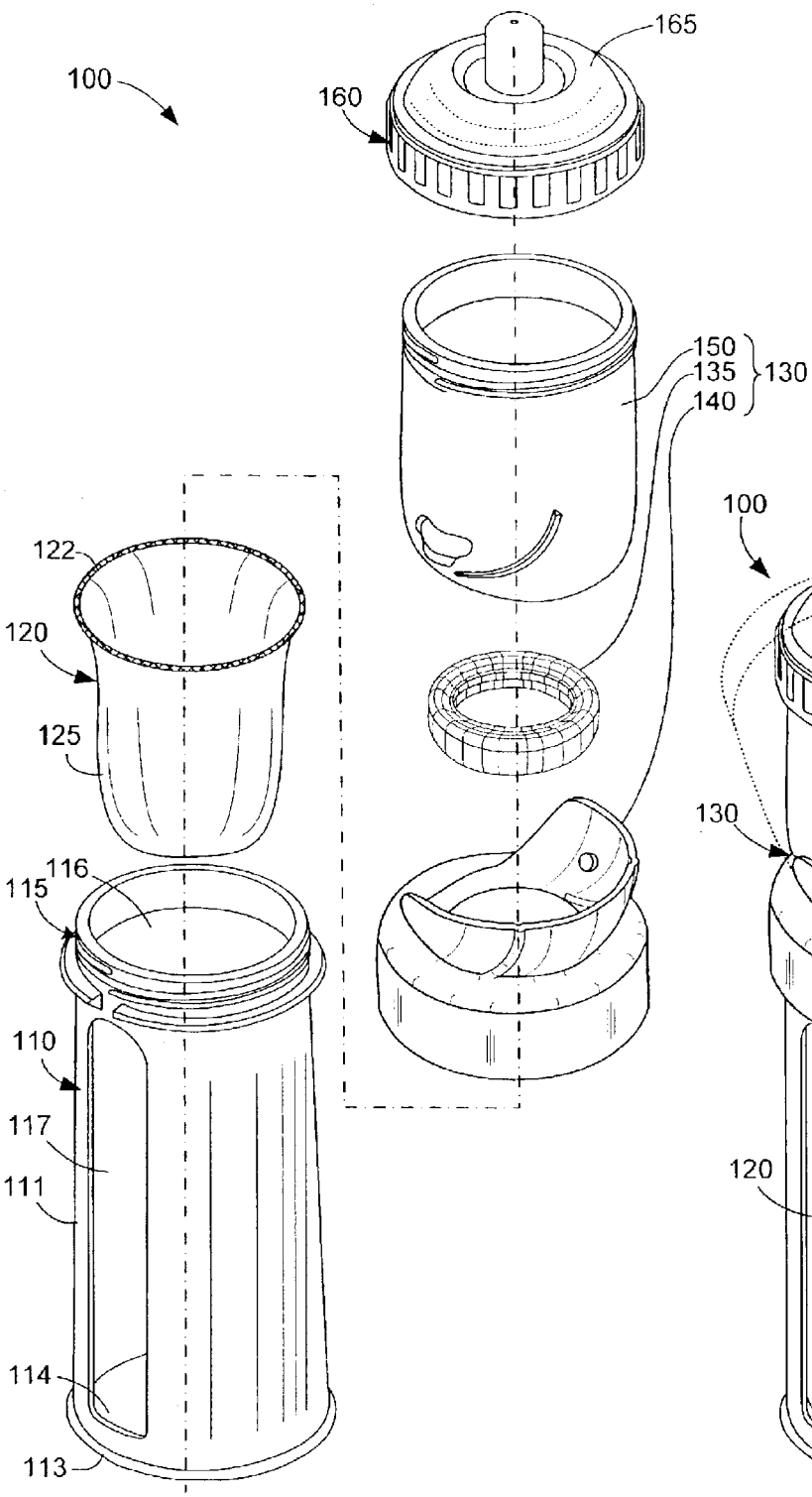
FIG. 1 is an exploded perspective view showing a multi-chambered baby bottle according to an embodiment of the present invention.
Figure 2:
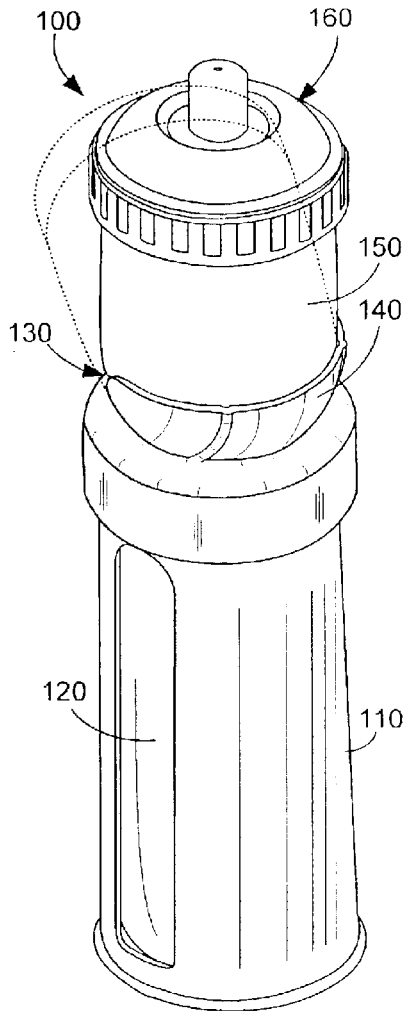
FIG. 2 is a perspective view showing the multi-chambered baby bottle assembly of FIG. 1.

FIGS. 1 and 2 are exploded perspective and perspective assembly views showing a multi-chambered container 100 according to an embodiment of the present invention. Referring to FIG. 1, multi-chambered container 100 includes a bottle sleeve (holder) 110, a disposable inner liner 120 that fits inside of sleeve 110, a two-piece adapter 130 including an optional o-ring 135, a base 140, and a hollow member 150, and a cap 160. When assembled as shown in FIG. 2, bottle sleeve 110 and liner 120 form a first chamber for holding a first substance (e.g., an unmixed liquid such as water, or a mixed liquid such as liquid baby formula), and adapter 130 provides a second chamber for storing a second substance (e.g., powdered baby formula).

Referring to the lower portion of FIG. 1, sleeve 110 is a substantially cylindrical, hollow structure that is typically molded from a relatively stiff plastic, and includes a substantially cylindrical outer wall 111 having a ring-shaped lower edge 113 defining a lower opening 114, and a threaded upper edge 115 defining an upper opening 116. Outer wall 111 also defines an optional longitudinal slot 117 for receiving a slidable support member (not shown). Liner 120 typically includes a pliable (e.g., plastic) bag or sac for storing a beverage (e.g., milk or baby formula), and in some instances is preformed to facilitate insertion into sleeve 110. Liner 120 includes an open edge 122 and a bag-like body 125 that is typically inserted through upper opening 116 of sleeve 110 until open edge 122 rests on upper edge 115 of sleeve 110. Cap 160 is a substantially ring-shaped structure that is molded from relatively stiff plastic, and includes threads (not shown) that mate with either upper edge 115 or the upper threaded portion of hollow member 150. A rubber or plastic nipple 165 is typically mounted onto cap 160. During use, beverage is sucked out of liner 120, through hollow member 150, and through an opening formed in nipple 165, thereby causing liner 120 collapses inside of sleeve 110. After use, liner 120 is typically discarded, and sleeve 110, cap 160, and nipple 165 are typically washed and reused. Note that bottle sleeve 110 and disposable liner 120 for a container that, along with cap 160, form a conventional disposable nurser similar to those sold by Playtex Products Inc. of Westport, Conn., USA. In another embodiment, another container (e.g., a standard reusable baby bottle) may be utilized in place of bottle sleeve 110 and disposable liner 120.

As indicated in FIGS. 1 and 2, adapter 130 is mounted between bottle sleeve 110 and nipple 160. When adapter base 140 is mounted onto upper edge 115 of sleeve 100, a lip of adapter base 140 pinches open edge 122 of liner 120 against upper edge 115 of sleeve 110. As set forth below, hollow member 150 is adjustable between a first (closed) position (indicated by dashed lines in FIG. 2) in which a curved wall of hollow member 150 blocks the opening into liner 120 such that the second substance stored in hollow member 150 is separated from the first substance stored in liner 120, and a second (open) position (indicated by solid lines in FIG. 2) in which on opening formed in the wall of hollow member 150 is aligned with the opening into liner 120, thereby allowing the second substance to enter liner 120 and mixes with the first substance. Subsequently, the mixed beverage is sucked out of liner 120, through hollow member 150, and through an opening formed in nipple 140.

According to an embodiment of the present invention, optional o-ring 135 is a collared o-ring constructed as described in co-owned and co-pending U.S. patent application Ser. No. 10/339,855, entitled "MULTI-CHAMBERED CONTAINER WITH COLLARED O-RING", filed Jan. 10, 2003, which is incorporated herein by reference in its entirety. In other possible embodiments, a standard donut-shaped o-ring may be used, or an o-ring may be entirely omitted (although this would increase the chances of unwanted leakage).

Adapter 130 will now be discussed in detail with reference to FIGS. 3 through 9.

Figure 3:
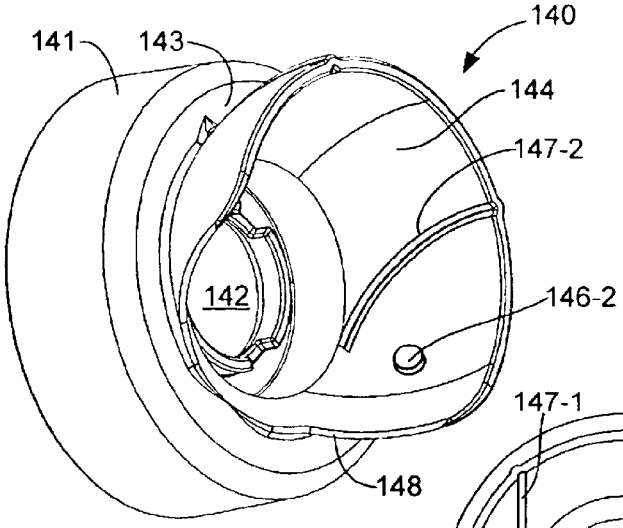
FIG. 3 is a perspective view showing a base of an adapter utilized in the multi-chambered baby bottle of FIG. 1.
Figure 5:
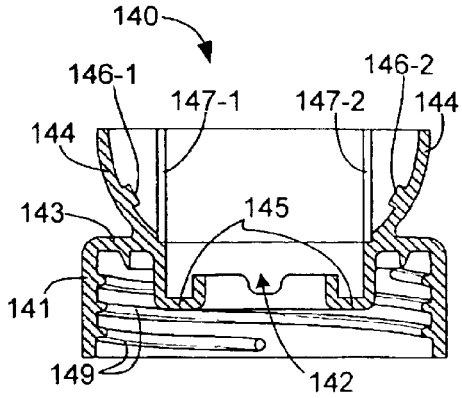
FIG. 5 is a cross-sectional side view taken along section line 5—5 of FIG. 4.
Figure 4:
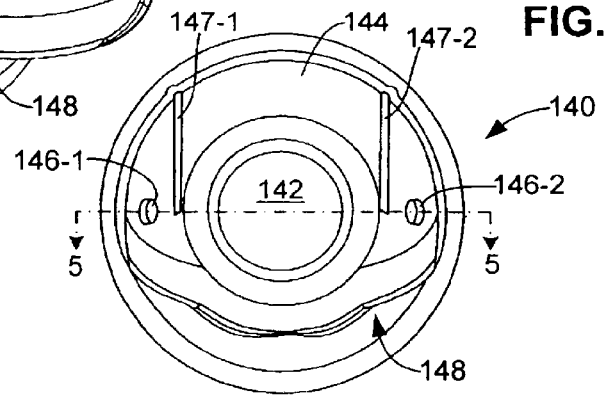
FIG. 4 is a top plan view of the adapter base shown in FIG. 3.

FIG. 3 is a perspective view showing base 140 of adapter 130, FIG. 4 is a top plan view of base 140, and FIG. 5 is a cross-sectional side view taken along section line 5—5 of FIG. 4. Referring to FIG. 3, base 140 includes a cylindrical lower ring 141 surrounding a central (first) opening 142, a disk or washer-shaped flange 143 extending inward from an upper edge of lower ring 141, and a substantially semi-spherical curved (concave) wall 144 extending from an upper (first) surface of flange 143. As indicated in FIG. 5, an o-ring mounting structure 145 extends downward from a lower (second) surface of flange 143, and is utilized to support o-ring 135 (FIG. 1). As shown in FIGS. 4 and 5, a first pin 146-1 and a second pin 146-2 protrude from an inner surface of wall 144, and are arranged on opposite sides of inner surface of wall 144 such that a line (e.g., section line 5—5 in FIG. 4) passing through first and second pins 146-1 and 146-2 bisects central opening 142. Wall 144 also defines a first groove 147-1 and a second groove 147-2 that define parallel planes located on opposite sides of central opening 142. Concave wall 144 also defines a slot 148 whose purpose will become clear below. Threads 149 are formed on the inner surface of lower ring 141 to facilitate connection to, for example, threaded upper edge 115 of sleeve 110 (see FIG. 1). As indicated in FIG. 5, central opening 142 passes through lower ring 141, flange 143, concave wall 144 and o-ring mounting structure 145.

Figure 6:
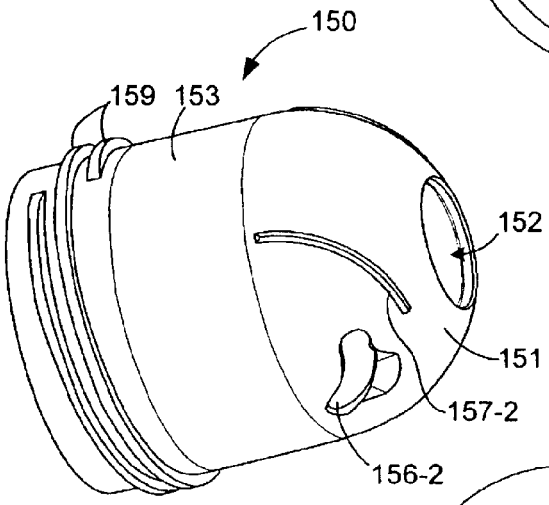
FIG. 6 is a perspective view showing a hollow member of the adapter utilized in the multi-chambered baby bottle of FIG. 1.
Figure 7:
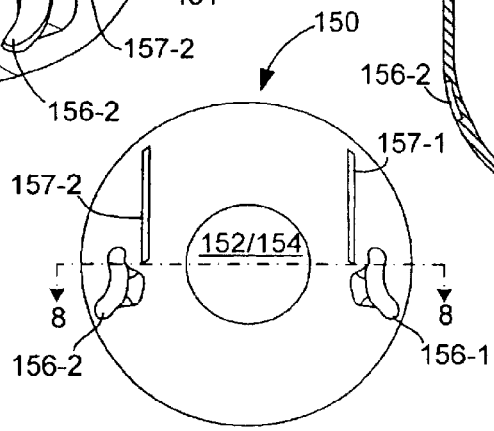
FIG. 7 is a top plan view of the hollow member shown in FIG. 6.
Figure 8:
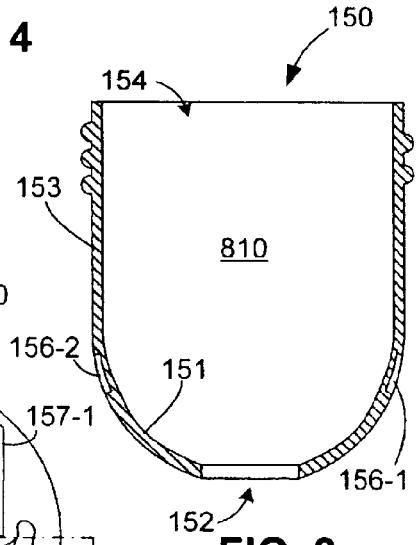
FIG. 8 is a cross-sectional side view taken along section line 8—8 of FIG. 7.

FIG. 6 is a perspective view showing hollow member 150 of adapter 130, FIG. 7 is a bottom plan view of hollow member 150, and FIG. 8 is a cross-sectional side view taken along section line 5—5 of FIG. 4. As indicated in FIG. 6, hollow member 150 includes a substantially semi-spherical (curved) convex wall 151 defining a lower (second) opening 152, and a cylindrical upper wall 153 extending from the wide end of convex wall 151. As indicated in FIG. 8, convex wall 151 and cylindrical upper wall 153 define a central chamber 810 that is accessible through lower opening 152 at the narrow end of convex wall 151, and through a selectively sealable upper (third) opening 154 defined at the upper end of cylindrical wall 153. Cylindrical upper wall 153 and/or convex wall 151 also define a first cam groove 156-1 and a second cam groove 156-2 located on opposite sides of hollow member 150. Wall 151 also defines a first guide rib 157-1 157-2 and a second guide rib 157-2 that define parallel planes located on opposite sides of lower opening 152. Threads 159 are formed on the outside surface of cylindrical wall 153 adjacent to upper opening 154 to facilitate connection of, for example, nipple 160 (see FIG. 1).

According to an aspect of the present invention, hollow member 150 is moveably coupled to base 140 by pressing convex wall 151 into concave wall 144 until pins 146-1 and 146-2 are respectively inserted into cam grooves 156-1 and 156-2. As described below with reference to FIGS. 9(A) through 9(C), in this coupled state pins 146-1 and 146-2 are slidably maintained in cam grooves 156-1 and 156-2, respectively, thereby allowing hollow member 150 to pivot relative to base 140.

Figure 9A:
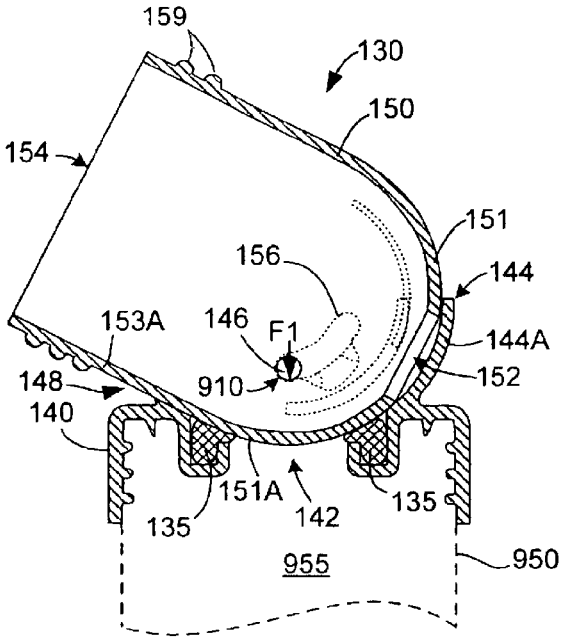
FIG. 9(A) through 9(D) are simplified cross-sectional side views showing various operating positions of the adapter.
Figure 9B:
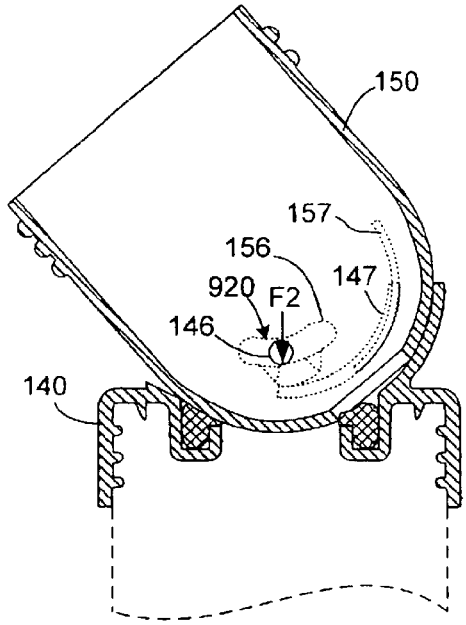
Figure 9C:
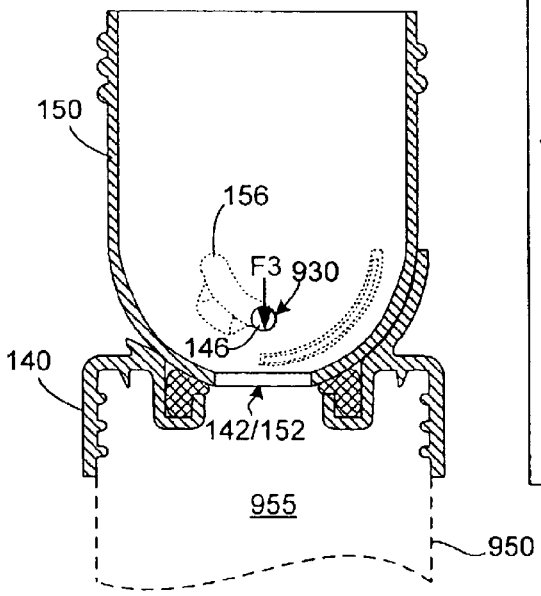

FIGS. 9(A) through 9(C) are simplified cross-sectional side views showing adapter 130 during operation. For descriptive purposes, in these figures first and second pins 146-1 and 146-2 (see, for example, FIG. 4) are commonly referred to as pin 146, and first and second cam grooves 156-1 and 156-2 (see, for example, FIG. 7) are commonly referred to as cam groove 156. Note that common pin 146 and common cam groove 156 represent the relative simultaneous positioning of both pins and both grooves. Similarly, first and second grooves 147-1 and 147-2 (see, for example, FIG. 4) are commonly referred to as groove 147, and first and second guide ribs 157-1 and 157-2 (see, for example, FIG. 7) are commonly referred to as guide rib 157.

FIG. 9(A) shows hollow member 150 in a first position relative to base 140 in which a portion 154A of convex wall 154 is positioned to block central opening 142 of base 140. Note that cylindrical wall portion 153A extends through slot 148, which is provided to facilitate pivoting of hollow member 150 into the first position. Also, pin 146 is positioned in a first locking region 910 of cam groove 156 such that a side wall of cam groove 156 is biased downward by a relatively large force F1 exerted by pin 146, thereby biasing hollow member 150 against base 140 such that wall portion 151A presses against o-ring 135 to reliably seal central opening 142. Note also that in the first position lower opening 152 is positioned over and blocked by a portion 144A of concave wall 144 to prevent the passage of substances through opening 152. Accordingly, as indicated in FIG. 9(A), a first substance (e.g., water) stored in a first chamber 955 of a container housing 950, which is secured below base 140, is kept separated from a second substance (e.g., powdered baby formula) stored in hollow member 150. Note also that this second substance can be conveniently inserted through relatively wide third opening 154, which is then sealed by mounting a cap (e.g., cap 160; see FIGS. 1 and 2) onto threads 159.

FIG. 9(B) shows hollow member 150 in a transitional position relative to base 140 in which pin 146 is positioned in a central region 920 of cam groove 156. Note that cam groove 156 is shaped such that pin 146 exerts a force F2, which is less than force F1 (or zero force) against the side wall of cam groove 156, thereby allowing relatively easy rotation (pivoting) of hollow member 150 relative to base 140. Note that this pivoting/sliding operation is partially constrained by the engagement of guide rib 157 in groove 147. That is, when hollow member 150 is pivoted between the first position shown in FIG. 9(A) and the second position shown in FIG. 9(C), guide rib 157 is engaged with and slides along groove 147.

FIG. 9(C) shows hollow member 150 in a second position relative to base 140 in which central opening 142 of base 140 is aligned with lower opening 152 of hollow member 150, thereby allowing a substance stored in hollow member 150 to pass through these openings and enter a chamber 955 of container 950. Note that pin 146 is positioned in a second locking region 930 of cam groove 156 such that a side wall of cam groove 156 is biased downward by a relatively large force F3 exerted by pin 146, thereby biasing hollow member 150 against base 140 in a manner similar to that associated with the first position (described above).

Figure 9D:
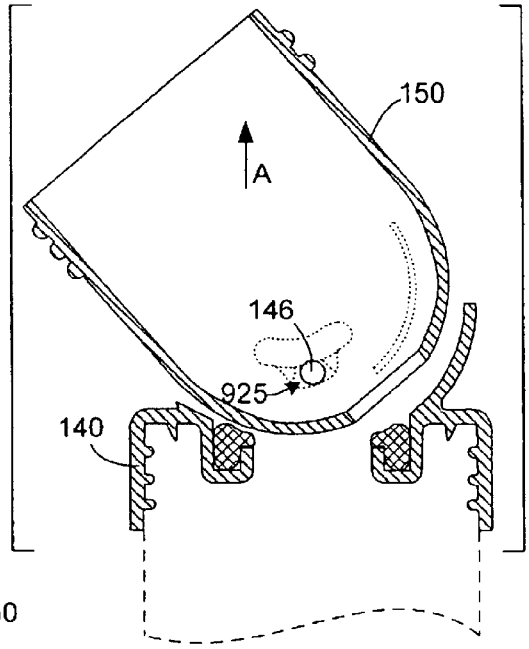

FIG. 9(D) shows hollow member 150 in another position relative to base 140 in which pin 146 is positioned in central region 920, and then hollow member 150 is pulled upward (in the direction of arrow A) relative to base 140. This action causes pin 146 to slide into a separation region 925 of cam groove 156, which facilitates easy separation of hollow member 150 from base 140.

In addition to the specific embodiment disclosed herein, other features and aspects may be added to the novel structures disclosed herein that fall within the spirit and scope of the present invention. For example, base 140 may be combined (integrally molded onto) container 950 such that the base/container provides a first chamber and hollow member 150 provides a second chamber of a two-chambered container assembly. In addition, although walls 144 and 154 are described as being substantially semi-spherical, these walls may be formed with other curved shapes. Further, connection mechanisms other than the disclosed pins and cam grooves may be utilized. In view of this and other possible modifications, the invention is limited only by the following claims.

What is claimed is:

1. An adapter for attaching over an open end of a container to form a multi-chambered container, the adapter comprising:

a base defining a first opening, said base including a first pin and a second pin; and a hollow member including a curved wall defining a second opening, the hollow member also defining a first cam groove and a second cam groove, wherein the hollow member is coupled to the base such that the first pin is slidably received in the first cam groove and the second pin is slidably received in the second cam groove, and such that the hollow member is moveable between a first position in which a portion of the curved wall is disposed to block the first opening, and a second position in which the second opening aligns with the first opening to form a passage through the first second openings, wherein each of the first and second cam grooves defines a first locking region and a second locking region, wherein when the hollow member is in the first position, the first locking region of the first cam groove is biased by the first pin and the first locking region of the second cam groove is biased by the second pin such that the hollow member is biased against the base with said portion of the curved wall disposed to block the first opening, and wherein when the hollow member is in the second position, the second locking region of the first cam groove is biased by the first pin and the second locking region of the second cam groove is biased by the second pin such that the hollow member is biased against the base with said second opening aligned with the first opening.

2. The adapter according to claim 1, wherein the base further comprises a substantially semi-spherical wall surrounding the first opening, wherein the first and second pins extend from an inside surface of the semi-spherical wall and are arranged such that a line passing through the first and second pins bisects the first opening, wherein the curved wall of the hollow member is substantially semi-spherical, and wherein the first and second cam grooves are formed on opposite sides of the substantially semi-spherical curved wall.

3. The adapter according to claim 2, wherein the substantially semi-spherical wall of the base defines first and second grooves, and wherein the substantially semi-spherical curved wall of the hollow member includes first and second guide ribs that are arranged to slide in the first and second grooves, respectively, when the hollow member is moved between the first position and the second position.

4. The adapter according to claim 1, wherein the curved wall of the hollow member comprises a substantially semi-spherical wall section defining said second opening, and wherein the first and second cam grooves are formed on the substantially semi-spherical wall section.

5. The adapter according to claim 1, wherein the base includes an o-ring mounting structure surrounding the first opening, and the adapter further comprises an o-ring received in the o-ring mounting structure.

6. An adapter for attaching over an open end of a container to form a multi-chambered container, the adapter comprising:

a base defining a first opening and including a substantially semi-spherical concave wall surrounding the first opening; and a hollow member including a substantially semi-spherical convex wall defining a second opening and having a wide end, and a substantially cylindrical wall extending from the wide end of the convex wall and defining a third opening, wherein the hollow member is moveably coupled to the base such that pivoting of the hollow member relative to the base causes the convex wall to slide against the concave wall of the base.

7. The adapter according to claim 6, wherein said base further comprises a first pin and a second pin extending from an inside surface of the substantially semi-spherical concave wall; and wherein the substantially semi-spherical convex wall of the hollow member further defines a first cam groove and a second cam groove, and wherein the hollow member is coupled to the base such that the first pin is slidably received in the first cam groove and the second pin is slidably received in the second cam groove.

8. The adapter according to claim 7, wherein the hollow member is coupled to the base such that the hollow member is moveable between a first position in which a portion of the convex wall is disposed to block the first opening, and a second position in which the first opening aligns with the second opening to form a passage between the first opening and an interior of the hollow member.

9. The adapter according to claim 8, wherein each of the first and second cam grooves defines a first locking region and a second locking region, wherein when the hollow member is in the first position, the first locking region of the first cam groove is biased by the first pin and the first locking region of the second cam groove is biased by the second pin such that the hollow member is biased against the base with said portion of the convex wall disposed to block the first opening, and wherein when the hollow member is in the second position, the second locking region of the first cam groove is biased by the first pin and the second locking region of the second cam groove is biased by the second pin such that the hollow member is biased against the base with the second opening aligned with the first opening.

10. The adapter according to claim 7, wherein the first and second pins are arranged such that a line passing through the first and second pins bisects the first opening.

11. The adapter according to claim 6, wherein the base further comprises a disk-shaped flange defining said first opening, wherein the substantially semi-spherical concave wall extends from a first side of the flange, and wherein the base further comprises an o-ring mounting structure extending from a second side of the flange.

12. The adapter according to claim 6, wherein the substantially semi-spherical concave wall of the base defines first and second grooves, and wherein the substantially semi-spherical convex wall of the hollow member includes first and second guide ribs that are arranged to slide in the first and second grooves, respectively, when the hollow member is moved between the first position and the second position.

13. A multi-chambered container comprising:

a base defining a first opening and including a curved concave wall surrounding the first opening; and a hollow member including a substantially semi-spherical convex wall defining a second opening and having a wide end, and a cylindrical wall extending from the wide end of the convex wall and defining a selectively sealable third opening, wherein the hollow member is coupled to the base such that the hollow member is moveable between a first position in which a portion of the convex wall is disposed to block the first opening, and a second position in which the first opening aligns with the second opening to form a passage between a first chamber located on a first side of the first opening, and a second chamber located on a second side of the first opening and inside the hollow member.

14. The multi-chambered container according to claim 13, wherein said base further comprises a first pin and a second pin extending from an inside surface of the curved concave wall; and wherein the convex wall of the hollow member further defines a first cam groove and a second cam groove, and wherein the hollow member is coupled to the base such that the first pin is slidably received in the first cam groove and the second pin is slidably received in the second cam groove.

15. The multi-chambered container according to claim 14, wherein each of the first and second cam grooves define a first locking region and a second locking region, wherein when the hollow member is in the first position, the first locking region of the first cam groove is biased by the first pin and the first locking region of the second cam groove is biased by the second pin such that the hollow member is biased against the base with said portion of the convex wall disposed to block the first opening, and wherein when the hollow member is in the second position, the second locking region of the first cam groove is biased by the first pin and the second locking region of the second cam groove is biased by the second pin such that the hollow member is biased against the base with said second opening aligned with the first opening.

16. The multi-chambered container according to claim 13, wherein the curved concave wall of the base defines first and second grooves, and wherein the convex wall of the hollow member includes first and second guide ribs that are arranged to slide in the first and second grooves, respectively, when the hollow member is moved between the first position and the second position.

17. The multi-chambered container according to claim 13, further comprising a cover mounted on the hollow member over the selectively sealable third opening.

18. The multi-chambered container according to claim 13, wherein the base includes an o-ring mounting structure surrounding the first opening, and the multi-chambered container further comprises an o-ring received in the o-ring mounting structure.

19. The multi-chambered container according to claim 18, wherein the o-ring mounting structure includes an annular groove surrounding the first opening, and wherein the o-ring includes an annular base mounted in the groove and a ring-shaped collar extending from the base outside of the groove and toward the first opening.

* * * * *